US008226211B2

(12) United States Patent
Ito

(10) Patent No.: US 8,226,211 B2
(45) Date of Patent: Jul. 24, 2012

(54) LIQUID DISCHARGE HEAD AND PRINTER

(75) Inventor: Atsushi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 372 days.

(21) Appl. No.: 12/535,189

(22) Filed: Aug. 4, 2009

(65) Prior Publication Data

US 2010/0033537 A1 Feb. 11, 2010

(30) Foreign Application Priority Data

Aug. 5, 2008 (JP) ..... 2008-201869

(51) Int. Cl.
*B41J 2/14* (2006.01)
*B41J 2/16* (2006.01)

(52) U.S. Cl. ..... 347/49

(58) Field of Classification Search ..... None
See application file for complete search history.

(56) References Cited

U.S. PATENT DOCUMENTS

2006/0098057 A1* 5/2006 Ito ..... 347/71
2008/0030556 A1* 2/2008 Sugahara ..... 347/85

FOREIGN PATENT DOCUMENTS

JP 2003-320664 11/2003
JP 2006-035545 2/2006
JP 2006-062259 3/2006
JP 2007-030242 2/2007
JP 2008-037099 2/2008

* cited by examiner

*Primary Examiner* — Matthew Luu
*Assistant Examiner* — Renee I Wilson
(74) *Attorney, Agent, or Firm* — Frommer Lawrence & Haug LLP

(57) ABSTRACT

A plurality of pressure chambers are arranged in two arrays in a direction intersecting an extending direction of a common liquid chamber. First pressure chambers of one array and second pressure chambers of the other array are disposed in a staggered arrangement. First and second connecting channels extend, in the intersection direction, from the first and second pressure chambers through areas located between the second and first pressure chambers up to areas outside the common liquid chamber to make communication with the common liquid chamber, respectively. The first and second connecting channels are arranged alternately in relation to the extending direction. Accordingly, both of the insurance of the length of the connecting channel and the small sizing of a head are satisfied.

7 Claims, 11 Drawing Sheets

LIQUID DISCHARGE HEAD AND PRINTER

CROSS REFERENCE TO RELATED APPLICATION

The present application claims priority from Japanese Patent Application No. 2008-201869, filed on Aug. 5, 2008, the disclosure of which is incorporated herein by reference in its entirety.

BACKGROUND OF THE INVENTION

1. Field of the Invention

The present invention relates to a liquid discharge head having a plurality of nozzles for jetting a liquid, including, for example, an ink-jet head to be carried, for example, on an ink-jet printer. The present invention relates to a printer such as an ink-jet printer.

2. Description of the Related Art

The ink-jet head is provided with a channel unit which has ink channels communicated with nozzles, and an actuator which is stacked on the channel unit. The ink channel has a common ink chamber to which an ink is supplied from an ink supply source, a plurality of pressure chambers which are provided corresponding to the plurality of nozzles, and a plurality of connecting channels which are provided individually for the respective pressure chambers in order to supply the ink contained in the common ink chamber to the respective pressure chambers. The actuator allows the pressure wave to act on the ink contained in the pressure chamber. Accordingly, the ink contained in the pressure chamber is discharged from the nozzle.

In a certain ink-jet head, the resolution is improved by the following configuration, wherein the ink-jet head has two arrays of pressure chambers and two arrays of nozzles which are aligned in the direction perpendicular to the extending direction of a single common ink chamber, and the respective pressure chamber arrays and the nozzle arrays extend in the extending direction of the common ink chamber. In order to improve the resolution for the nozzle group which forms the two nozzle arrays, the nozzles, which form the respective nozzle arrays, are disposed in a zigzag or staggered arrangement, and the pressure chambers, which form the respective pressure chambers, are also disposed in a zigzag or staggered arrangement in the same manner as described above. The connecting channels, which are provided corresponding to the pressure chambers which form one array, are arranged to extend in the direction perpendicular to the extending direction of the common ink chamber between the mutual pressure chambers which form the other array.

In order to improve the resolution, it is also effective to decrease the ink droplets by decreasing the nozzle diameter. However, if the nozzle diameter is decreased, the channel resistance of the nozzle is increased in accordance therewith. On the other hand, in order that the pressure wave, which is allowed to act on the ink contained in the pressure chamber, is transmitted to the nozzle to discharge a desired amount of the ink, it is desirable that the channel resistance, which is approximately the same as that of the nozzle, is also established for the connecting channel which is disposed on the upstream side of the pressure chamber. For this reason, a throttle channel, which has a small cross-sectional area of the channel, is generally formed at a part of the connecting channel of the channel unit.

In another inkjet head, a connecting channel is arranged to be inclined with respect to the extending direction of a common ink chamber as viewed in a plan view in order to lengthen a throttle channel of the connecting channel and increase the channel resistance of the connecting channel. Accordingly, even when the nozzle diameter is decreased, then the ink is discharged from the nozzle appropriately when the pressure wave is allowed to act on the ink contained in a pressure chamber, and the ink contained in the ink channel stably flows.

However, in the case of the former ink-jet head, it is possible to realize the highly densified arrangement of the nozzles, while it is difficult to secure a large length of the connecting channel. Therefore, it is difficult for the connecting channel to establish any channel resistance which is approximately the same as that of the nozzle.

In the case of the latter ink-jet head, the connecting channel is arranged while being inclined. In other words, the pressure chamber array is arranged while being deviated or deflected in the extending direction of the common ink chamber with respect to the common ink chamber. In the case of the arrangement of the common ink chamber, the pressure chamber array, and the connecting channels of the another ink-jet head, it is feared that the channel unit may be large-sized in the direction of arrangement of the pressure chamber array, i.e., in the extending direction of the common ink chamber, and the whole ink-jet head may be large-sized.

SUMMARY OF THE INVENTION

In view of the above, an object of the present invention is to satisfy both of the insurance of the length of a connecting channel and the small sizing or miniaturization of a head.

The present invention has been made taking the foregoing circumstances into consideration. According to an aspect of the present invention, there is provided a liquid discharge head which discharges a liquid, including:

a channel unit including:

a first pressure-chamber array in which a plurality of first pressure chambers are aligned in one direction;

a second pressure-chamber array which is arranged next to the first pressure-chamber array in an intersection direction intersecting the one direction, and in which a plurality of second pressure chambers are aligned in the one direction;

a plurality of nozzles which are formed corresponding to the first and second pressure chambers, respectively, and through which the liquid is discharged;

a common liquid chamber storing the liquid which is commonly distributed to the first and second pressure chambers and extending in the one direction; and a plurality of connecting channels through which the liquid is supplied from the common liquid chamber to the first and second pressure chambers, the connecting channels having a plurality of first connecting channels corresponding to the first pressure chambers and a plurality of second connecting channels corresponding to the second pressure chambers; and an actuator unit which selectively applies a discharge pressure to the liquid in the first and second pressure chambers, wherein the first and second pressure chamber arrays are arranged on one side and the other side of the common liquid chamber in the intersection direction, respectively, such that the first and second pressure chambers are arranged in a staggered manner in the one direction, each of the first connecting channels extends in the intersection direction from one of the first pressure chambers in a portion of the channel unit between the second pressure chambers, up to an area, of the channel unit, not overlapped with the common liquid chamber on the other side of the common liquid chamber to make communication with the common liquid chamber;

each of second connecting channels extends in the intersection direction from one of the second pressure chambers in a portion of the channel unit between the first pressure chambers, up to an area, of the channel unit, not overlapped with the common liquid chamber on the one side of the common liquid chamber to make communication with the common liquid chamber; and the first connecting channels and the second connecting channels are arranged alternately in relation to the one direction.

When the arrangement as described above is adopted, the connecting channels are arranged to extend in the direction intersecting with the extending direction of the common liquid chamber. Therefore, it is possible to miniaturize or small-size the ink-jet head. The portion of the connecting channel, which is disposed on the side of the communication with the common liquid chamber, is arranged at the outside with respect to the plan view contour line of the common ink chamber as viewed in a plan view. Therefore, it is possible to lengthen the connecting channel. Therefore, it is easy to establish a desired value of the channel resistance of the connecting channel. Thus, it is possible to stabilize the flow of the ink.

According to the present invention, as clarified from the foregoing explanation, it is possible to provide the liquid discharge head which contributes to the miniaturization or small sizing.

DESCRIPTION OF THE PREFERRED EMBODIMENTS

An explanation will be made below with reference to the attached drawings about an ink-jet head as exemplarily described as an embodiment of the liquid discharge head according to the present invention. The following explanation will be made assuming that the direction, in which inks are discharged from nozzles of the ink-jet head, is designated as "downward direction", and the direction, which is opposite thereto, is designated as "upward direction".

First Embodiment

Figure 1:
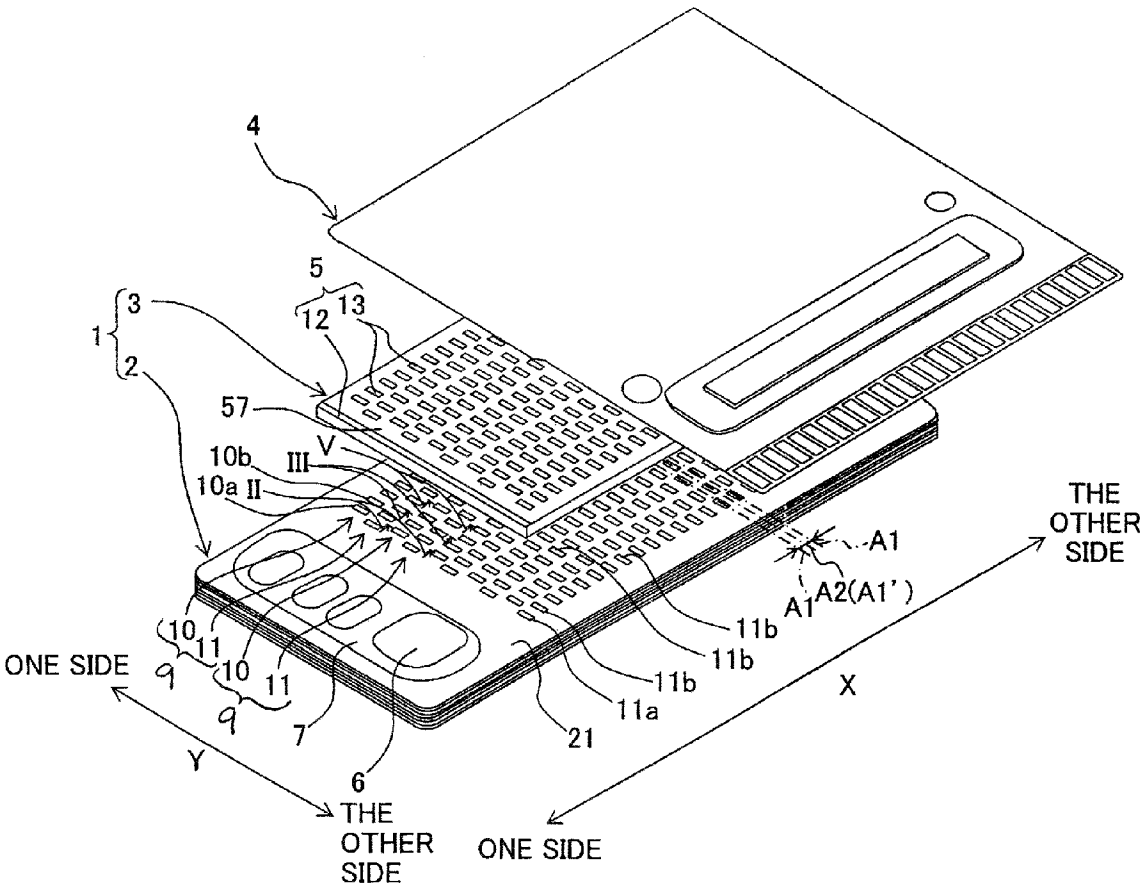
FIG. 1 shows an exploded perspective view illustrating an ink-jet head of a first embodiment according to the present invention.

As shown in FIG. 1, the ink-jet head 1 is provided with a channel unit 2 which includes a plurality of stacked plates, and a piezoelectric type actuator 3 which is overlapped and adhered on the upper side with respect to the channel unit 2. Surface electrodes 5 are formed on the upper surface of the actuator 3. A flexible flat cable 4, which is provided to effect the electric connection to the external equipment, is overlapped and adhered on the upper side of the surface electrodes 5. Terminals (not shown) are exposed on the lower surface of the flexible flat cable 4. The terminals are electrically brought in conduction with the surface electrodes 5 of the actuator 3.

The channel unit 2 and the actuator 3 are formed to have substantially rectangular shapes as viewed in a plan view respectively. Conveniently, in the following description, the "X direction" is designated as the direction in which the long side of the rectangular shaped channel unit 2 (the actuator 3) extends, and the "Y direction" is designated as the direction in which the short side thereof extends and which is perpendicular to the X direction. The X and Y directions define the plane (horizontal plane in this case) which is perpendicular to the discharge direction of the ink. The lower-left side and the upper-right side, which are shown in FIG. 1 in relation to the X direction, are designated as "one side" and "the other side" respectively. The upper-left side and the lower-right side, which are shown in FIG. 1 in relation to the Y direction, are designated as "one side" and "the other side" respectively.

Four ink inflow ports 6 are formed on the upper surface of the channel unit 2. The respective ink inflow ports 6 are aligned while being separated from each other by intervals or spacing distances in the Y direction on one side in the X direction of the channel unit 2. The respective ink inflow ports 6 are connected to ink tanks (not shown) via ink supply routes (not shown). The inks contained in the respective ink tanks are supplied to the corresponding ink inflow ports 6. A filter 7, which covers the respective ink inflow ports 6, is provided on the upper surface of the channel unit 2. The inks, which are filtrated by the filter 7, pass through the respective ink inflow ports 6.

The respective ink inflow ports 6 are communicated with the nozzles 35 which are open on the lower surface of the channel unit 2 (see FIGS. 2 to 5) via ink channels 30 which are formed in the channel unit 2 (see FIGS. 2 to 5). Two series of the ink channels are communicated with the ink inflow port 6 arranged at the end portion on the other side in the Y direction. One series of the ink channel is communicated with each of the other ink inflow ports 6. In other words, five series of the ink channels, which are independent from each other, are formed in the channel unit 2.

A plurality of through-holes (pressure chamber holes) are formed on the upper surface of the channel unit 2. Each of the pressure chamber holes is formed to have a rectangular shape in which the Y direction is the longitudinal direction thereof. When the pressure chamber holes are closed by the lower surface of the actuator 3, they constitute pressure chambers 10*a*, 10*b*, 11*a*, 11*b* (see FIGS. 2 to 5) which are parts of the ink channels 30 (see FIGS. 2 to 5).

The plurality of pressure chambers 10*a*, 10*b*, 11*a*, 11*b* form five pressure chamber array groups 9 which are aligned in the X direction corresponding to the series of the ink channels 30 (see FIGS. 2 to 5).

In particular, each of the pressure chamber array groups 9 has a first pressure chamber array 10 which includes the plurality of pressure chambers 10*a*, 10*b* disposed at equal intervals in the X direction, and a second pressure chamber array 11 which is provided in proximity on the other side in the Y direction of the first pressure chamber array 10 and which includes the plurality of pressure chambers 11*a*, 11*b* disposed at equal intervals in the X direction. For the convenience of explanation in this specification, the pressure chamber, which is included in the plurality of pressure chambers for forming the first pressure chamber array 10 and which is arranged on an odd-numbered row as counted from one side in the Y direction, is designated as "pressure chamber 10*a*". The pressure chamber, which is arranged on an even-numbered row, is designated as "pressure chamber 10*b*". Similarly, the pressure chamber, which is included in the plurality of pressure chambers for forming the second pressure chamber array 11 and which is arranged on an odd-numbered row as counted from one side in the Y direction, is designated as "pressure chamber 11*a*". The pressure chamber, which is arranged on an even-numbered row, is designated as "pressure chamber 11*b*". Similarly thereto, the suffixes "a" and "b" are also added to the reference numerals, for example, for the channels as described later on. The pressure chambers 10*a*, 10*b* for constructing the first pressure chamber array 10 and the pressure chambers 11*a*, 11*b* for constructing the second pressure chamber array 11 are disposed in a staggered arrangement. Taking the notice of the two adjoining pressure chamber array groups 9, the second pressure chamber array 11, which is included in the pressure chamber array group 9 positioned on one side in the Y direction of the two, is provided closely to the first pressure chamber array 10 which is included in the pressure chamber array group 9 positioned on the other side in the Y direction. The pressure chambers 11*a*, 11*b* for constructing the second pressure chamber array 11 and the pressure chambers 10*a*, 10*b* for constructing the first pressure chamber array 10 are disposed in a staggered arrangement.

The phrase "disposed in a staggered arrangement" refers to the fact that the center line A2 of the pressure chamber for constructing the other pressure chamber array is arranged between the respective center lines A1 of the two pressure chambers which are adjacent to one another in the X direction and which are included in the pressure chambers for constructing one pressure chamber array. The "center line" is the center line of the pressure chamber in relation to the X direction which is the direction of disposition of the respective pressure chamber arrays 10, 11. In this embodiment, in order to dispose the pressure chambers in the staggered arrangement in a well-balanced manner, the pressure chamber arrays 10, 11 are disposed so that the center line A2 passes through just the middle of the two adjoining center lines A1.

Figure 2:
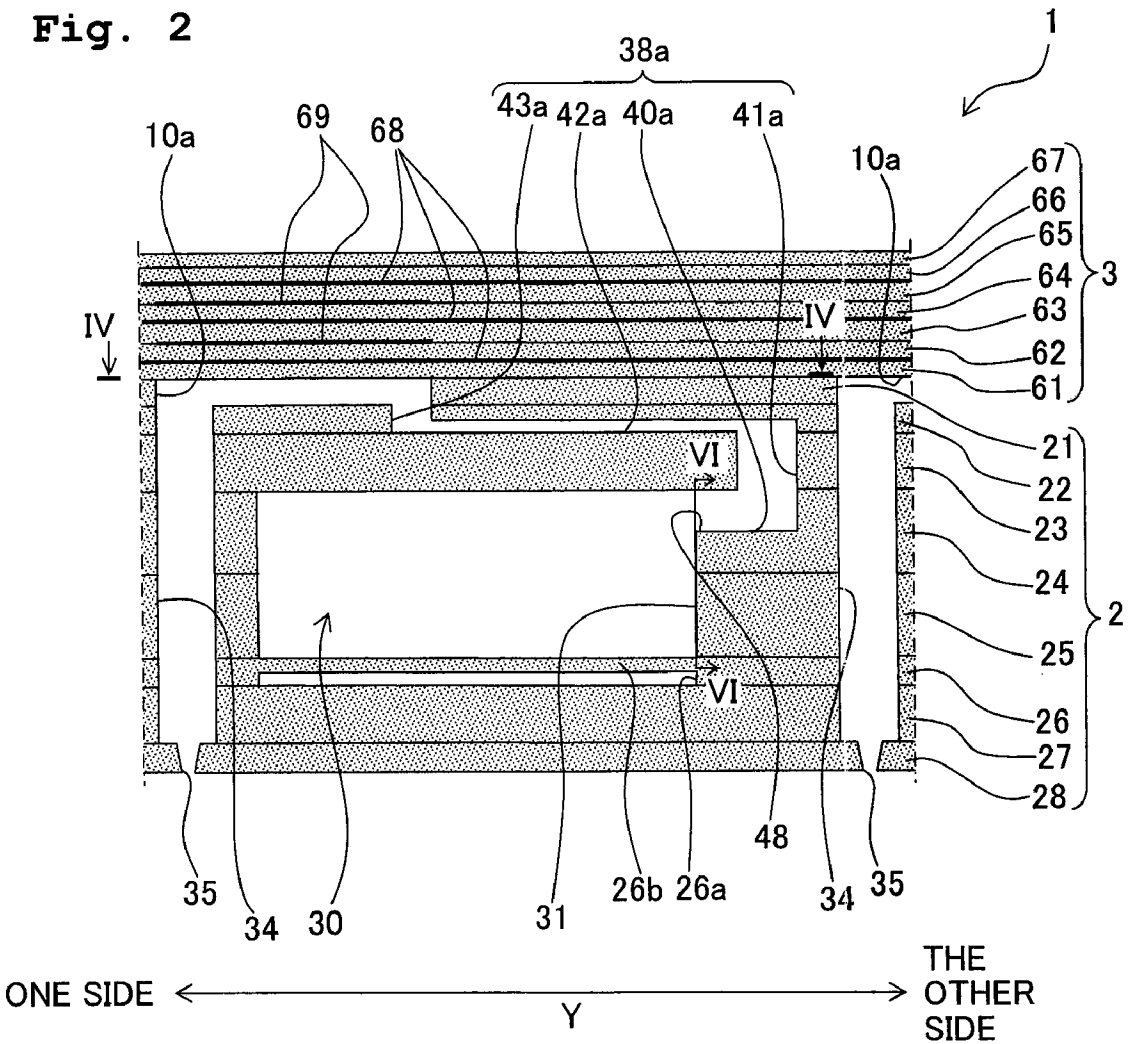
FIG. 2 shows a partial sectional view illustrating the ink-jet head as depicted by sectioning, along a II-II line shown in FIG. 1, the ink-jet head shown in FIG. 1 in the assembled state.
Figure 3:
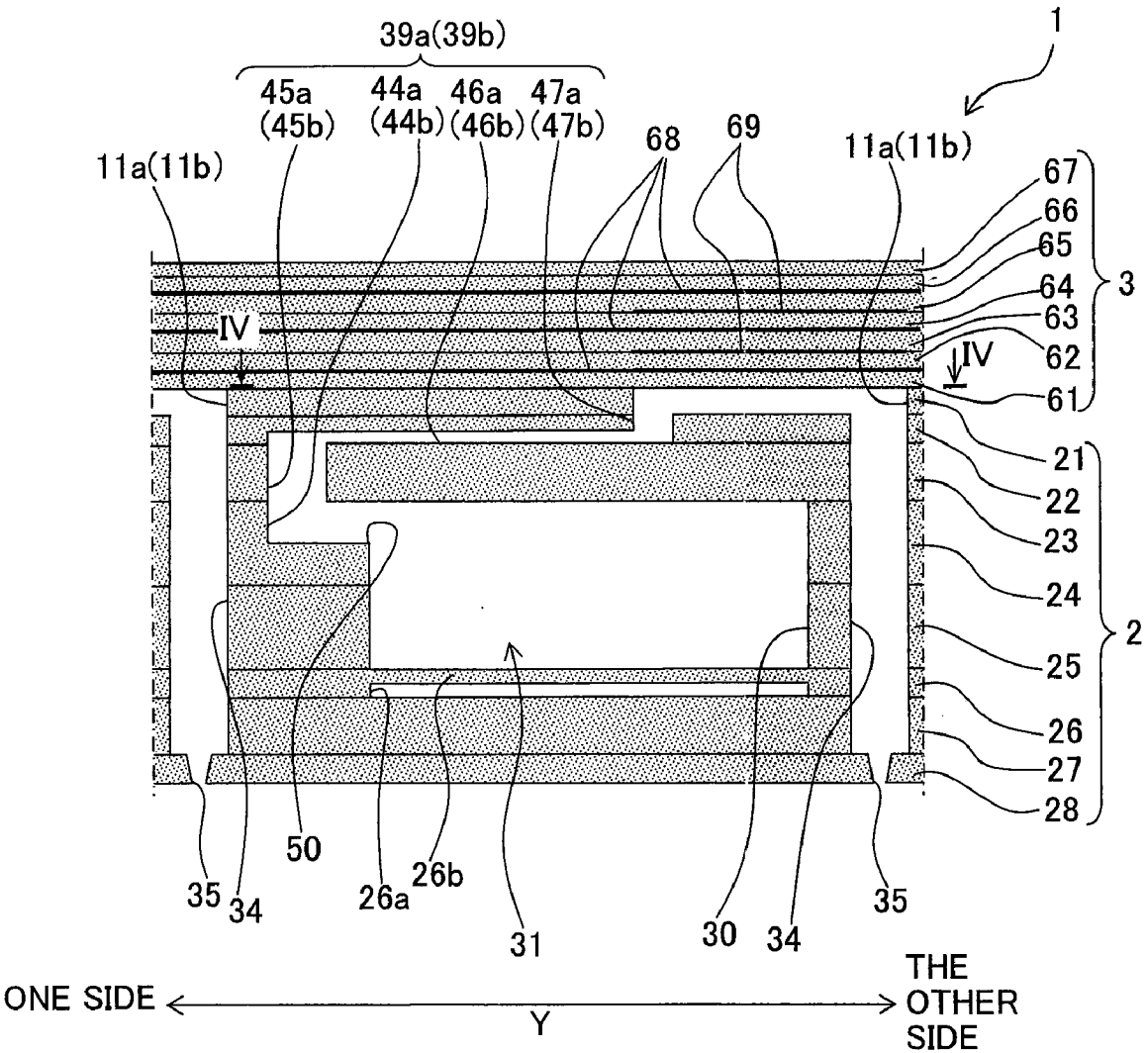
FIG. 3 shows a partial sectional view illustrating the ink-jet head as depicted by sectioning, along a III-III line shown in FIG. 1, the inkjet head shown in FIG. 1 in the assembled state.

FIG. 2 shows a vertical cross-sectional shape of the pressure chamber 10*a* included in the first pressure chamber array 10. FIG. 3 shows a vertical cross-sectional shape of the pressure chamber 11*a* included in the second pressure chamber array 11. The shape of the pressure chambers 10*b* is the same as that of the pressure chambers 11*a*.

As shown in FIGS. 2 and 3, the channel unit 2 of the inkjet head 1 includes a pressure chamber plate 21, a first connecting channel plate 22, a second connecting channel plate 23, a first manifold plate 24, a second manifold plate 25, a damper plate 26, a cover plate 27, and a nozzle plate 28 which are stacked in this order from the top and which are adhered to one another. The nozzle plate 28 is a resin sheet made of, for example, polyimide. The other plates 21 to 27 are metal plates of 42% nickel alloy steel plates (42 alloy) or stainless steel plates respectively, and they have thicknesses of about 50 to 150 μm respectively.

Openings and recesses are formed on the respective plates 21 to 28 by means of, for example, the electrolytic etching, the laser processing, and/or the plasma jet processing. When the respective plates 21 to 28 are stacked, then the openings and the recesses are communicated with each other, and the ink channels 30, which connect the ink inflow ports 6 (see FIG. 1) formed on the upper surface and the nozzles 35 open on the lower surface, are formed in the channel unit 2. The ink inflow ports 6 are formed for the pressure chamber plate 21 which is disposed at the uppermost layer (see FIG. 1). The nozzles 35 are formed for the nozzle plate 28 which is disposed at the lowermost layer (see FIGS. 2 and 3).

The ink channel 30 has an ink-introducing channel (not shown), a common ink chamber 31, connecting channels 38*a*, 38*b*, the pressure chambers 10*a*, 10*b*, 11*a*, 11*b*, and a descender 34 as referred to in this order from the upstream side. The unillustrated ink-introducing channel is constructed by unillustrated through-holes which are formed to penetrate through the first and second connecting channel plates 22, 23. The through-holes are arranged just under the ink inflow ports 6 (see FIG. 1) formed for the pressure chamber plate 21, and they are communicated with the common ink chambers 31.

The pressure chambers 10*a*, 10*b*, 11*a*, 11*b* are formed such that the upper and lower openings of the pressure chamber holes, which are formed penetratingly through the pressure chamber plate 21, are closed by the lower surface of the actuator 3 and the upper surface of the first connecting channel plate 22 respectively. The actuator 3 is smaller than the channel unit. The actuator 3 is arranged on the channel unit in a state in which the ink inflow ports 6 disposed on the pressure chamber plate 21 are exposed.

Figure 4:
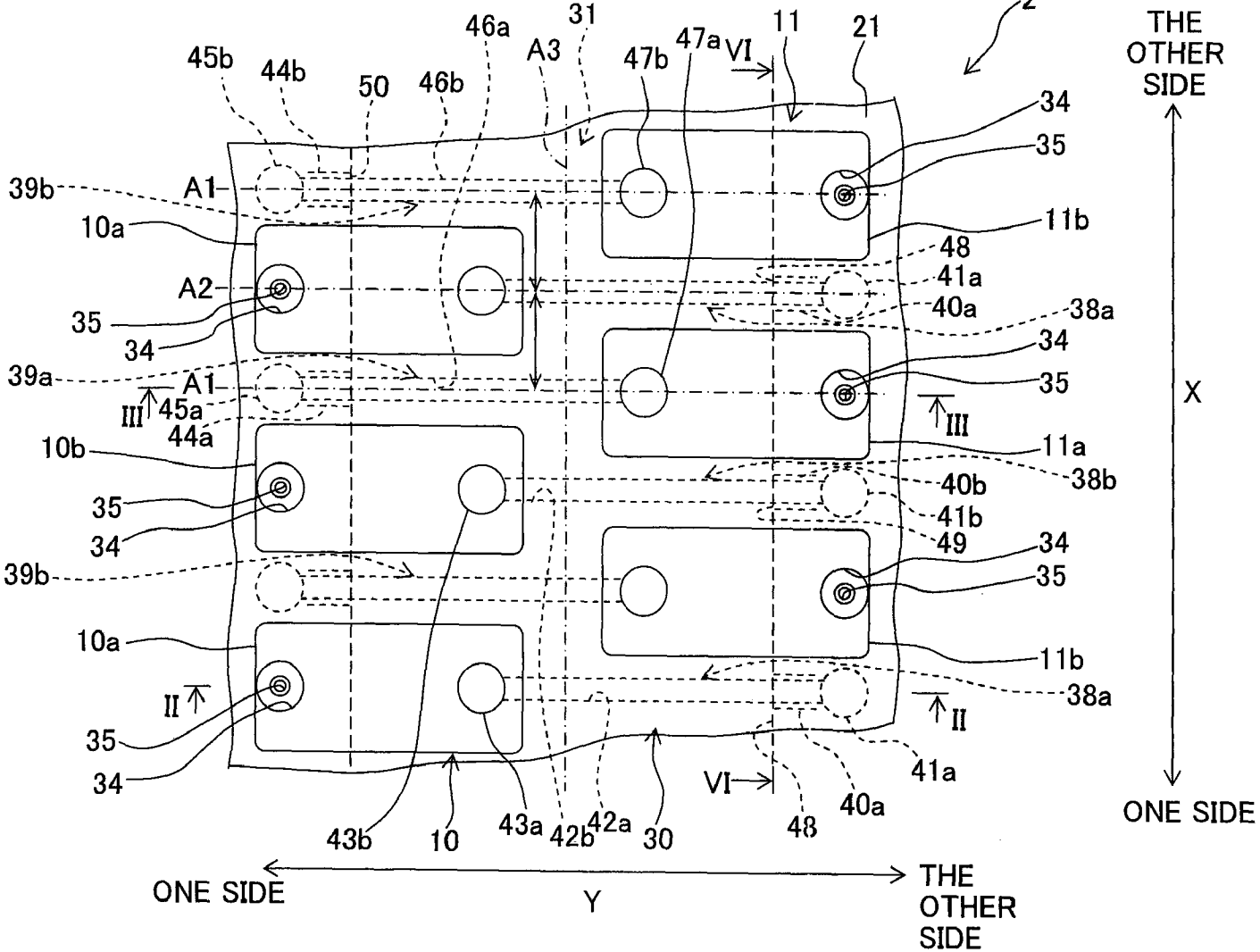
FIG. 4 shows a plan view illustrating a channel unit as depicted by sectioning the channel unit along a IV-IV line shown in FIGS. 2 3, i.e., a projection view as viewed in a plan view illustrating channels for constructing ink channels.

FIG. 4 shows a partial plan view illustrating the channel unit 2 taken along a IV-IV line shown in FIGS. 2 and 3, i.e., a view in which the channels for constructing ink channels 30 are projected as viewed in a plan view. FIG. 4 shows the staggered arrangement of the plurality of pressure chambers 10*a*, 10*b* included in the first pressure chamber array 10 and the plurality of pressure chambers 11*a*, 11*b* included in the second pressure chamber array 11 as described above.

As shown in FIGS. 2 and 3, the through-holes are formed through the first and second manifold plates 24, 25 respectively. The first and second manifold plates 24, 25 are stacked so that the through-holes are communicated with each other in the vertical direction. In this way, the common ink chamber 31 is defined such that the upper and lower openings of the two through-holes communicated in the vertical direction are closed by the lower surface of the second connecting channel plate 23 and the upper surface of the damper plate 26 respectively. In other words, the bottom wall of the common ink chamber 31 is defined by the damper plate 26. The half etching processing is applied to the area of the lower surface of the damper plate 26 overlapped with the common ink chamber 31. Accordingly, a recess 26*a*, which is open in the downward direction, is formed on the lower surface of the damper plate 26. The lower opening of the recess 26*a* is closed by the upper surface of the cover plate 27, and thus the bottom wall of the common ink chamber 31 functions as a damper wall 26*b* which is elastically deformable in the upward and downward directions.

With reference to FIG. 4, the common ink chamber 31 extends in the X direction in which the pressure chamber arrays 10, 11 extend. The end portion of the common ink chamber 31, which is disposed on one side in the X direction, arrives at the position just under the ink inflow port 6 (see FIG. 1). The downstream end of the ink-introducing channel (not shown) is communicated with the end portion disposed on one side in the X direction. The common ink chambers 31 are provided one by one for the respective series of the ink channels 30, and they are arranged while being separated from each other by the intervals or spacing distances in the Y direction.

The common ink chamber 31 is arranged between the first pressure chamber array 10 and the second pressure chamber array 11 which are disposed closely to one another in the Y direction. More specifically, the common ink chamber 31 is arranged so that the center line of the common ink chamber 31 in relation to the Y direction is positioned just at the center between the two adjoining pressure chamber arrays 10, 11 (see the alternate long and short dash line A3 shown in FIG. 4).

The end portions of the pressure chambers 10*a*, 10*b* included in the first pressure chamber array 10, which are disposed on the other side in the Y direction, are overlapped with the common ink chamber 31 as viewed in a plan view. The end portions of the pressure chambers 11*a*, 11*b* included in the second pressure chamber array 11, which are disposed on one side in the Y direction, are overlapped with the common ink chamber 31 as viewed in a plan view. In other words, the common ink chamber 31 is arranged to range over the pressure chamber arrays 10, 11 which are provided separately in the Y direction as viewed in a plan view.

As shown in FIGS. 2 and 3, the connecting channels (first connecting channels 38*a*, 38*b* and second connecting channels 39*a*, 39*b*) connect the common ink chamber 31 formed for the first and second manifold plates 24, 25 and the pressure chambers 10*a*, 10*b*, 11*a*, 11*b* formed for the pressure chamber plate 21 arranged at the uppermost layer respectively.

As shown in FIG. 4, the first and second connecting channels 38*a*, 38*b*, 39*a*, 39*b* are provided corresponding to the pressure chambers 10*a*, 10*b*, 11*a*, 11*b* respectively. Specifically, the first connecting channels 38*a*, 38*b* correspond to the pressure chambers 10*a*, 10*b* included in the first pressure chamber array 10 respectively. The second connecting channels 39*a*, 39*b* correspond to the pressure chambers 11*a*, 11*b* included in the second pressure chamber array 11 respectively. Any one of the first and second connecting channels 38*a*, 38*b*, 39*a*, 39*b* is formed in an aligned arrangement in the X direction which is the extending direction of the common ink chamber 31 and which is also the extending direction of the first and second pressure chamber arrays 10, 11. Any one of the first and second connecting channels 38*a*, 38*b*, 39*a*, 39*b* is communicated with the same common ink chamber 31. In this embodiment, the upstream ends of the first and second connecting channels 38*a*, 38*b*, 39*a*, 39*b* are communicated with the side surface of the common ink chamber 31, and the downstream ends are communicated with the end portions in the Y direction of the pressure chambers 10*a*, 10*b*, 11*a*, 11*b* respectively. The plurality of first connecting channels 38*a*, 38*b* are mutually disposed while providing the equal intervals in the X direction corresponding to the intervals of arrangement in the X direction of the plurality of pressure chambers 10*a*, 10*b* included in the first pressure chamber array 10. Similarly, the plurality of second connecting channels 39*a*, 39*b* are mutually disposed while providing the equal intervals in the X direction corresponding to the intervals of arrangement in the X direction of the plurality of pressure chambers 11*a*, 11*b* included in the second pressure chamber array 11. Detailed arrangement of the first and second connecting channels 38*a*, 38*b*, 39*a*, 39*b* will be described later on.

The descender 34 is provided corresponding to each of the pressure chambers 10*a*, 10*b*, 11*a*, 11*b*. The upstream end thereof is communicated with the end portion of each of the pressure chambers 10*a*, 10*b*, 11*a*, 11*b* disposed on the side far from the common ink chamber 31 in the Y direction.

As shown in FIGS. 2 and 3, the descenders 34 reside in the through-holes which are formed through the first connecting channel plate 22, the second connecting channel plate 23, the first manifold plate 24, the second manifold plate 25, the damper plate 26, and the cover plate 27 respectively. The plates 22 to 27 are stacked so that the through-holes are communicated with each other in the vertical direction. The descender 34 is formed by the through-holes. Further, the nozzles 35 are formed through the nozzle plate 28. The nozzle 35 and the descender 34 are communicated with each other. In other words, the nozzles 35 are provided corresponding to the respective pressure chambers 10*a*, 10*b*, 11*a*, 11*b*. The plurality of nozzles 35 are disposed in a staggered arrangement in the same manner as the pressure chambers 10*a*, 10*b*, 11*a*, 11*b* (see FIG. 4).

Owing to the channel unit 2, the inks, which are allowed to pass through the respective ink inflow ports 6 (see FIG. 1), are fed to the plurality of nozzles 35 via the corresponding ink channels 30. In other words, the ink, which is allowed to come from the ink inflow port 6, firstly inflows into the common ink chamber 31 via the ink-introducing channel (not shown). The ink, which is contained in the common ink chamber 31, is distributed and supplied to the plurality of pressure chambers 10*a*, 10*b*, 11*a*, 11*b* which form the two pressure chamber arrays 10, 11 via the respective connecting channels 38*a*, 38*b*, 39*a*, 39*b*. The ink, which is contained in each of the pressure chambers 10*a*, 10*b*, 11*a*, 11*b*, is supplied via the descender 34 to the corresponding nozzle 35.

As shown in FIGS. 2 and 3, the actuator 3 is constructed such that a plurality of piezoelectric sheets 61 to 66 and an insulative top sheet 67 are stacked and adhered in the vertical direction, wherein each one of the piezoelectric sheets 61 to 66, which is composed of a ceramics material of lead titanate zirconate (PZT), has a thickness of about 30 μm. Common electrodes 68, which are continuously arranged to cover all of the pressure chambers 10*a*, 10*b*, 11*a*, 11*b*, are printed and formed on the upper surfaces of the piezoelectric sheets 61, 63, 65 disposed on odd-numbered rows as counted from the bottom. A plurality of individual electrodes 69, which are arranged individually corresponding to the pressure chambers 10*a*, 10*b*, 11*a*, 11*b*, are printed and formed on the upper surfaces of the piezoelectric sheets 62, 64 disposed on even-numbered rows as counted from the bottom. The common electrodes 68 are in electric conduction with a common surface electrode 12 (see FIG. 1) printed and formed on the upper surface of the top sheet 67 disposed at the uppermost layer, via relay wirings (not shown) provided for the piezoelectric sheets 61 to 66 and the top sheet 67. The respective individual electrodes 69 are also in electric conduction with individual surface electrodes 13 (see FIG. 1) printed and formed on the upper surface of the top sheet 67 disposed at the uppermost layer, via similar relay wirings (not shown). With reference to FIG. 1, the common surface electrode 12 is formed to extend in the Y direction at the end portion on one side in the X direction of the upper surface of the top sheet 67. The plurality of individual surface electrodes 13 are disposed in a staggered arrangement corresponding to the pressure chambers 10*a*, 10*b*, 11*a*, 11*b*.

In the ink-jet head 1 constructed as described above, when the voltage is selectively applied to the individual electrode 69 of the actuator 3 via the flexible flat cable 4 (see FIG. 1), the electric potential difference arises between the individual electrode 69 and the common electrodes 68. In this situation, the active portions of the piezoelectric sheets 61 to 66, which are positioned between the electrodes 68, 69, are strained and deformed in the polarization direction (i.e., substantially in the stacking direction). Owing to the deformation of the active portions, the pressure wave is allowed to act on the pressure chamber 10*a*, 10*b*, 11*a*, 11*b* corresponding to the individual electrode 69 to which the voltage is applied, and the ink, to which the pressure is applied, passes through the descender 34 so that the ink is jetted from the nozzle 35 in the downward direction. In this situation, the pressure wave, which is allowed to act on the pressure chamber 10*a*, 10*b*, 11*a*, 11*b*, contains not only the frontward movement component directed toward the nozzle 35 but also the backward movement component directed toward the common ink chamber 31 via the connecting channel 38*a*, 38*b*, 39*a*, 39*b*. The backward movement component of the pressure wave, which is transmitted to the common ink chamber 31, is absorbed by the elastic deformation of the damper wall 26*b*. Accordingly, the so-called crosstalk phenomenon is avoided, which would be otherwise caused such that the backward movement component of the pressure wave generated in a certain pressure chamber is transmitted to the other pressure chamber via the common ink chamber 31. In general, the absorption performance to absorb the pressure wave, which is brought about by the elastic deformation of the damper wall 26*b*, is proportional to the fifth power of the width (size or dimension in the Y direction) of the damper wall 26*b*. In the case of the ink-jet head 1, the common ink chamber 31 and the damper wall 26*b* are arranged to range over the two pressure chamber arrays 10, 11 as viewed in a plan view. The areal sizes of the common ink chamber 31 and the damper wall 26*b* are increased as large as possible as viewed in a plan view. Therefore, even when the ink-jet head 1 is highly densified, the absorption performance to absorb the pressure wave can be raised as high as possible. The arrangement and the function of the ink-jet head 1 having been already explained are common to the respective embodiments according to the present invention.

Next, the connecting channels 38*a*, 38*b*, 39*a*, 39*b* of the first embodiment will be explained in detail. FIG. 2 shows the cross-sectional shapes taken along the II-II line of the pressure chamber 10*a* and the first connecting channel 38*a* communicated therewith. FIG. 3 shows the cross-sectional shapes taken along the III-III line of the pressure chamber 11*a* and the second connecting channel 39*a* communicated therewith.

As shown in FIG. 2, the first connecting channel 38*a* has a first upstream channel 40*a*, a second upstream channel 41*a*, a throttle channel 42*a*, and a downstream channel 43*a* as referred to in this order from the side of the common ink chamber 31. In order to construct the channels, through-holes or grooves are formed for the first and second connecting channel plates 22, 23 and the first manifold plate 24. An example will be described later on about the processing of the second manifold plate 25 in order to construct the first connecting channel 38*a*.

The upper surface side of the first manifold plate 24 is subjected to the half etching processing. Accordingly, the first upstream channel 40*a*, which has a groove shape open on the upper surface, is formed for the first manifold plate 24. The first upstream channel 40*a* extends from the upper edge portion on the other side in the Y direction of the common ink chamber 31 toward the other side in the Y direction. In this way, the first upstream channel 40*a* is formed such that the upper opening of the groove formed for the first manifold plate 24 is closed by the lower surface of the second connecting channel plate 23. As described above, the upstream end of the first upstream channel 40*a* is communicated with the upper end portion on the other side in the Y direction of the common ink chamber 31. The first upstream channel 40*a* extends from the upstream end toward the other side in the Y direction. The extending direction is opposite to the side on which the pressure chamber 10*a* to be connected is arranged, with respect to the common ink chamber 31.

The second upstream channel 41*a* is formed as the through-hole at the position of the second connecting channel plate 23 corresponding to the forward end portion of the first upstream channel 40*a*. When the first manifold plate 24 and the second connecting channel plate 23 are stacked, the lower opening of the second upstream channel 41*a* is communicated with the forward end portion of the upper opening of the first upstream channel 40*a*. In this way, the second upstream channel 41*a* is constructed by the through-hole to extend in the stacking direction. The upstream end thereof is communicated with the downstream end of the first upstream channel 40*a*.

The lower surface side of the first connecting channel plate 22 is subjected to the half etching processing. Accordingly, the throttle channel 42*a*, which has a groove shape open on the lower surface, is formed for the first connecting channel plate 22. The throttle channel 42*a* extends from the position of the second connecting channel plate 23 corresponding to the second upstream channel 41*a* in relation to the Y direction to the position corresponding to the end portion in the Y direction of the pressure chamber 10*a*, the end portion being disposed on the side nearer to the common ink chamber 31 (on one side in the Y direction). Further, the downstream channel 43*a*, which penetrates in the vertical direction, is formed for the first connecting channel plate 22 at the end portion on one side in the Y direction of the throttle channel 42*a*. The downstream channel 43*a* is formed after forming the throttle channel 42*a*.

When the first and second connecting channel plates 22, 23 are stacked, the lower opening of the throttle channel 42*a* is closed by the upper surface of the second connecting channel plate 23. In this situation, the downstream end of the second upstream channel 41*a* of the second connecting channel plate 23 is communicated with the upstream end of the throttle channel 42*a*. When the pressure chamber plate 21 and the first connecting channel plate 22 are stacked, the downstream channel 43*a* of the first connecting channel plate 22 is communicated with the pressure chamber 10*a*. In this way, the downstream channel 43*a* extends in the stacking direction to make communication between the downstream end of the throttle channel 42*a* and the end portion in the Y direction of the pressure chamber 10*a*, the end portion being disposed on the side nearer to the common ink chamber 31 (on one side in the Y direction).

As shown in FIG. 3, the second connecting channel 39*a* has a first upstream channel 44*a*, a second upstream channel 45*a*, a throttle channel 46*a*, and a downstream channel 47*a* as referred to in this order from the side of the common ink chamber 31 as well, in the same manner as the first connecting channel 38*a*. In order to construct the channels, through-holes and grooves are formed for the first and second connecting channel plates 22, 23 and the first manifold plate 24.

The first upstream channel 44*a* is formed to have a groove shape by applying the half etching processing to the upper surface of the first manifold plate 24. The first upstream channel 44*a* extends from the upper edge portion on one side in the Y direction of the common ink chamber 31 toward one side in the Y direction. The upper opening of the first upstream channel 44*a* is closed by the lower surface of the second connecting channel plate 23. In this way, the upstream end of the first upstream channel 44*a* is communicated with the upper end portion on one side in the Y direction of the common ink chamber 31. The first upstream channel 44*a* extends from the upstream end toward the side opposite to the side (the other side in the Y direction) on which the pressure chamber 33 is arranged, with respect to the common ink chamber 31.

The second upstream channel 45*a* is formed at the position of the second connecting channel plate 23 corresponding to the forward end portion of the first upstream channel 44*a*. When the first manifold plate 24 and the second connecting channel plate 23 are stacked, the second upstream channel 45*a* is communicated with the forward end portion of the first upstream channel 44*a*. In this way, the second upstream channel 45*a* is constructed by the through-hole to extend in the stacking direction, and the upstream end thereof is communicated with the downstream end of the first upstream channel 44*a*.

The throttle channel 46*a* is formed to have a groove shape by applying the half etching processing to the lower surface of the first connecting channel plate 22. The throttle channel 46*a* extends from the position of the second connecting channel plate 23 corresponding to the second upstream channel 45*a* in relation to the Y direction to the position corresponding to the end portion in the Y direction of the pressure chamber 11*a*, the end portion being disposed on the side nearer to the common ink chamber 31 (on the other side in the Y direction). Further, the downstream channel 47*a* is formed for the first connecting channel plate 22 by the through-hole which penetrates in the vertical direction at the end portion on the other side in the Y direction of the throttle channel 46*a*.

When the first and second connecting channel plates 22, 23 are stacked, the lower opening of the throttle channel 46*a* is closed by the upper surface of the second connecting channel plate 23. In this situation, the downstream end of the second upstream channel 45*a* is communicated with the upstream end of the throttle channel 46*a*. When the pressure chamber plate 21 and the first connecting channel plate 22 are stacked, the downstream channel 47*a* is communicated with the pressure chamber 11*a*. In this way, the downstream channel 47*a* extends in the stacking direction to make communication between the downstream end of the throttle channel 46*a* and the end portion in the Y direction of the pressure chamber 11*a*, the end portion being disposed on the side nearer to the common ink chamber 31 (on other side in the Y direction).

As described above, the first and second connecting channels 38*a*, 39*a* have the throttle channels 42*a*, 46*a* which are constructed by the grooves and which have the large channel resistances (small cross-sectional areas of the channels) respectively. Therefore, the backward movement components of the pressure waves, which are allowed to act on the pressure chambers 10*a*, 11*a*, are attenuated during the process of the passage through the first and second connecting channels 38*a*, 39*a*.

With reference to FIG. 4, the first connecting channel 38*a* (38*b*) extends in the Y direction as the direction perpendicular to the direction of disposition of the pressure chambers 11*a*, 11*b* between the pressure chambers 11*a*, 11*b* which form the second pressure chamber array 11 as viewed in a plan view. Similarly, the second connecting channel 39*a* (39*b*) extends in the Y direction as the direction perpendicular to the direction of disposition of the pressure chambers 10*a*, 10*b* between the pressure chambers 10*a*, 10*b* which form the first pressure chamber array 10. The pressure chambers 10*a*, 10*b* for forming the first pressure chamber array 10 and the pressure chambers 11*a*, 11*b* for forming the second pressure chamber array 11 are disposed in the staggered arrangement. Therefore, the first connecting channel 38*a* (38*b*) and the second connecting channel 39*a* (39*b*) are arranged alternately in the X direction. The arrangement interval D is equal to the distance between the center line A1 of the pressure chamber 10*a*, 10*b* for forming the first pressure chamber array 10 and the center line A2 of the pressure chamber 11*a*, 11*b* for forming the second pressure chamber array 11.

In this way, when the first and second connecting channels 38*a* (38*b*), 39*a* (39*b*) are arranged in the direction perpendicular to the direction in which the common ink chamber 31 extends, it is possible to miniaturize or small-size the channel unit 2 in relation to the extending direction of the common ink chamber 31.

On the condition described above, the first and second upstream channels 40*a* (40*b*), 41*a* (41*b*), which form the upstream portions with respect to the throttle channel 42*a* (42*b*), are arranged outside the common ink chamber 31 as viewed in a plan view in relation to the first connecting channel 38*a* (38*b*). Further, the first and second upstream channels 40*a* (40*b*), 41*a* (41*b*) are arranged on the side opposite to the side on which the pressure chamber 10*a* (10*b*) to be connected is arranged, in relation to the Y direction in which the throttle channel 42*a* (42*b*) extends. Therefore, it is possible to lengthen the throttle channel 42*a* (42*b*) as compared with a case in which the channels disposed on the upstream side of the throttle channel 42*a* (42*b*) are arranged inside the common ink chamber 31 as viewed in a plan view. Accordingly, the channel unit is miniaturized or small-sized. Further, it is possible to easily secure the channel resistance required for the first connecting channel 38*a* (38*b*).

The air sometimes makes invasion into the common ink chamber 31 together with the ink from the side of the ink inflow port 6 (see FIG. 1). The invasion air tends to stay or remain on the upper side in the vertical direction. In general, the inkjet printer is provided with a purge apparatus for applying the negative pressure to the ink channel 30 from the side of the nozzle 35. The air, which makes invasion into the ink channel 30, can be forcibly discharged together with the ink by means of the purge apparatus. With reference to FIGS. 2 and 3, the communication is made with the upper end portion of the common ink chamber 31 at which the air tends to stay or remain, in relation to the first upstream channel 40*a* (40*b*), 45*a* (45*b*) which forms the upstream portion of each of the first and second connecting channels 38*a* (38*b*), 39*a* (39*b*). Therefore, when the negative pressure is applied from the side of the nozzle 35, the air, which makes invasion into the common ink chamber 31, is easily guided to the connecting channel. The air is discharged more reliably.

In FIG. 4, the width (size or dimension in the X direction) of the first upstream channel 40*a* (40*b*), 45*a* (45*b*) is depicted to be larger than the width of the throttle channel 42*a* (42*b*), 46*a* (46*b*). However, the widths of the both may be equal to one another. Alternatively, the width of the throttle channel 42*a* (42*b*), 46*a* (46*b*) may be larger than the width of the first upstream channel 40*a* (40*b*), 45*a* (45*b*).

Next, the first connecting channel 38*b* will be explained in detail.

Figure 5:
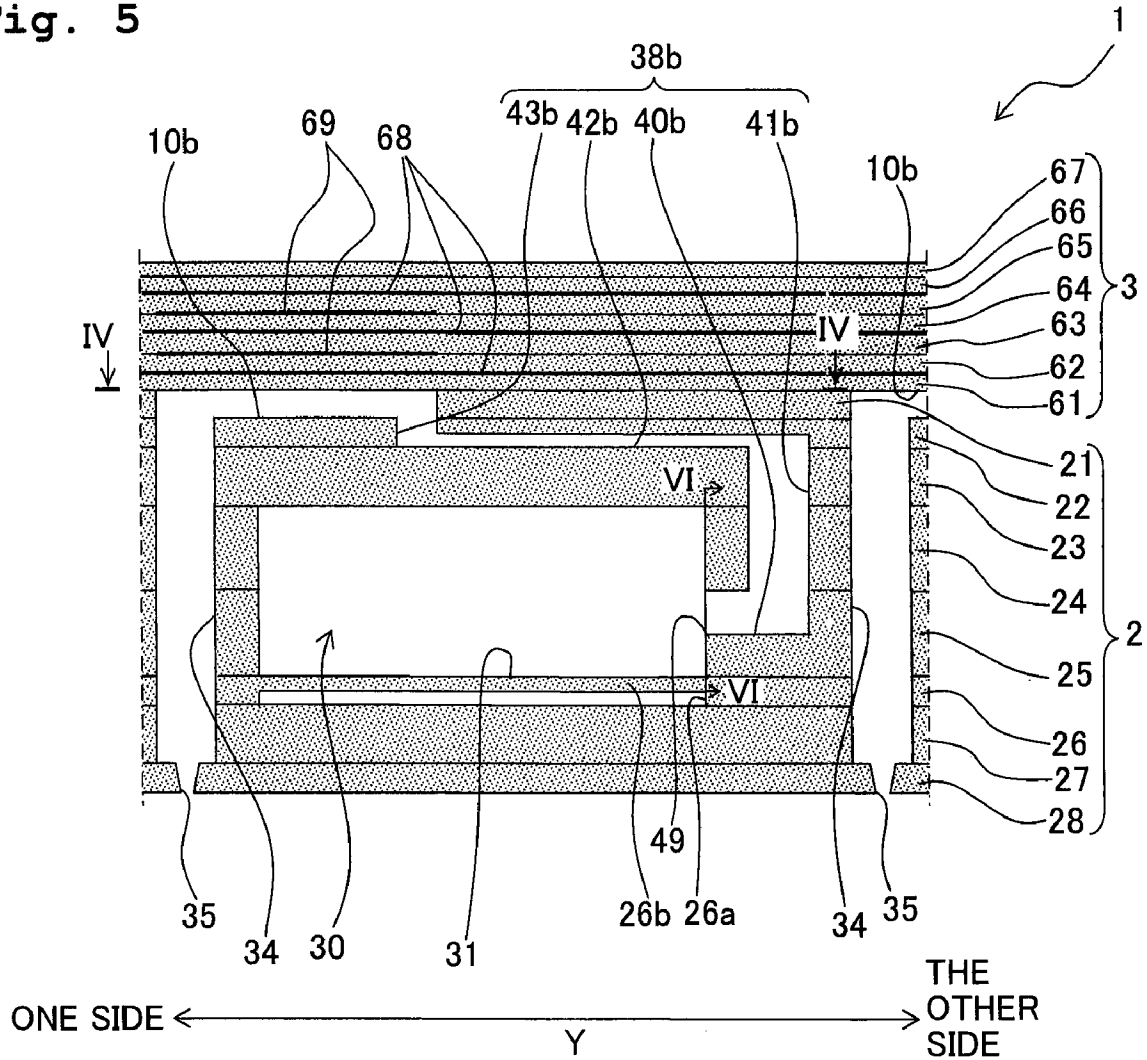
FIG. 5 shows a partial sectional view illustrating the ink-jet head as depicted by sectioning, along a V-V line shown in FIG. 1, the ink-jet head shown in FIG. 1 in the assembled state.

The first connecting channel 38*b* shown in FIG. 5 has the first upstream channel 40*b*, the second upstream channel 41*b*, the throttle channel 42*b*, and the downstream channel 43*b* in the same manner as the first connecting channel 38*a* shown in FIG. 2. When FIG. 2 is compared with FIG. 5, the throttle channel 42*a* and the throttle channel 42*b* are constructed in the same manner in relation to the first connecting channel 38*a* and the first connecting channel 38*b*. Similarly, the downstream channel 43*a* and the downstream channel 43*b* are constructed mutually in the same manner. However, the first upstream channels 40*a*, 40*b* are constructed differently from the second upstream channels 41*a*, 41*b*. The explanation has been already made about the arrangement of the first upstream channel 40*a* and the second upstream channel 41*a* and the arrangement of the throttle channel 42*a* and the downstream channel 43*a*, and hence any duplicate explanation will be omitted.

As shown in FIG. 5, the upper surface side of the second manifold plate 25 is subjected to the half etching processing. Accordingly, the groove-shaped first upstream channel 40*b*, which is open on the upper surface, is formed for the second manifold plate 25. The first upstream channel 40*b* extends from the edge portion on the other end in the Y direction of the common ink chamber 31 toward the other side in the Y direction. The upper opening of the first upstream channel 40*b* is closed by the lower surface of the second connecting channel plate 23. In this way, the upstream end of the first upstream channel 40*b* is communicated with the central portion in the height direction in the vertical direction on the other side in the Y direction of the common ink chamber 31. The first upstream channel 40*b* extends from the upstream end toward the other side in the Y direction. The extending direction is opposite to the side on which the pressure chamber 33 to be connected is arranged, with respect to the common ink chamber 31.

The through-hole is formed at the position of the first manifold plate 24 corresponding to the forward end portion of the first upstream channel 40*b*. The through-hole, which is communicated therewith, is also formed through the second connecting channel plate 23. When the second connecting channel plate 23 and the first and second manifold plates 24, 25 are stacked, the through-holes are communicated with each other to form the second upstream channel 41*b*. The second upstream channel 41*b* is constructed as the through-hole to extend in the stacking direction. The upstream end thereof is communicated with the downstream end of the first upstream channel 40*b*. When the first and second connecting channel plates 22, 23 are stacked, the downstream end of the second upstream channel 41*b* is communicated with the upstream end of the throttle channel 42*b*.

In this way, the first upstream channel 40*b* of the first connecting channel 38*b* connected to the pressure chamber 10*b* disposed on the even-numbered row and the first upstream channel 40*a* of the first connecting channel 38*a* connected to the pressure chamber 10*a* disposed on the odd-numbered row are formed at the mutually different positions in relation to the stacking direction. Accordingly, the lengths of the second upstream channels 40*a*, 40*b* are different from each other. On the other hand, with reference to FIG. 4, the shape of the first connecting channel 38*b* is the same as the shape of the first connecting channel 38*a* as viewed in a plan view.

Figure 6:
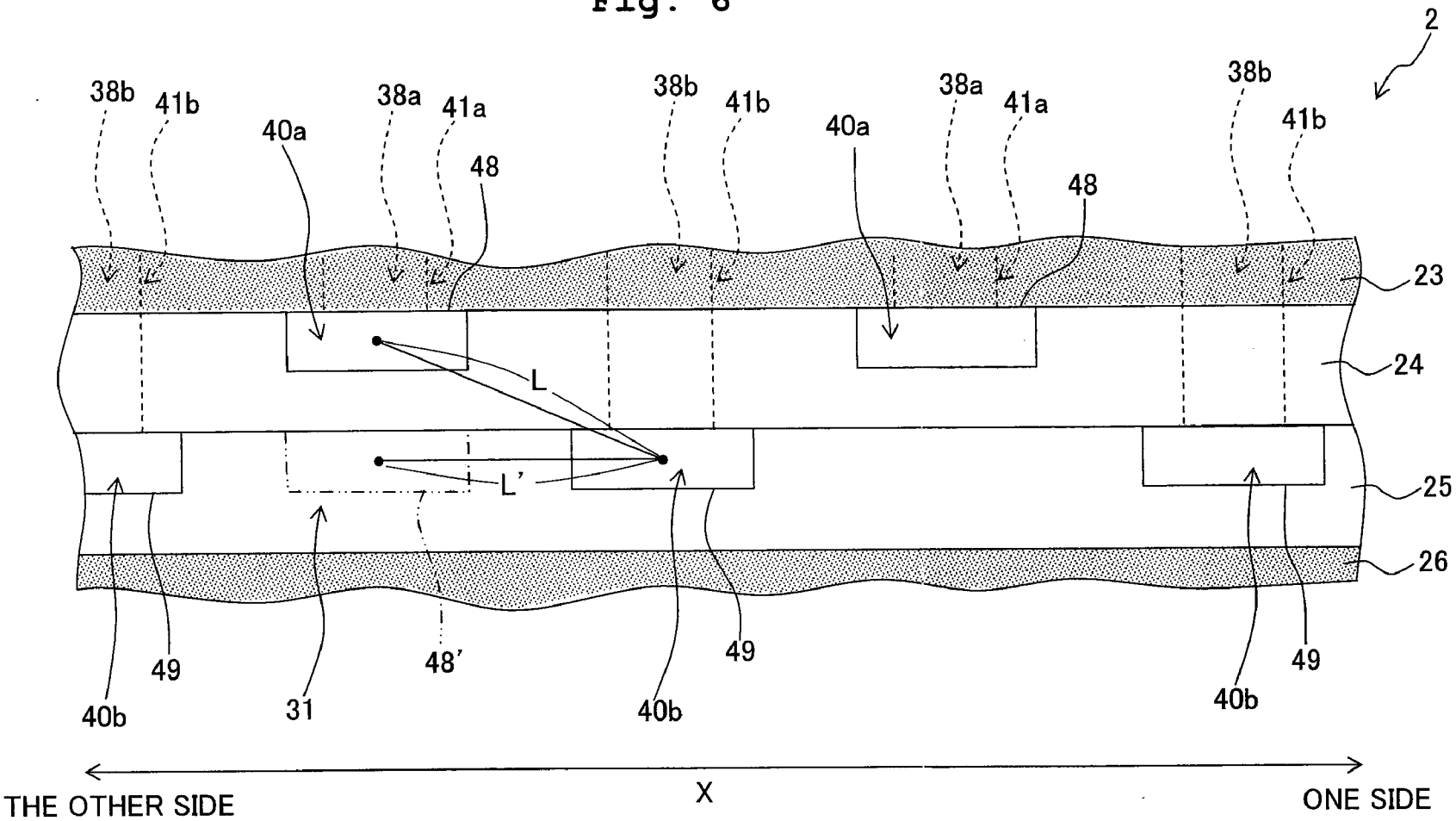
FIG. 6 shows a partial sectional view illustrating the channel unit as depicted by sectioning the channel unit along a VI-VI line shown in FIG. 5.

With reference to FIG. 6, the openings 48 of the first upstream channels 40*a* of the first connecting channels 38*a* connected to the pressure chambers 10*a* disposed on the odd-numbered rows and the openings 49 of the second upstream channels 41*b* of the first connecting channels 38*b* connected to the pressure chambers 10*b* disposed on the even-numbered rows are alternately arranged in the X direction on the inner side surface on the other side in the Y direction as one of the side surfaces for defining the depth direction of the common ink chamber 31. On the condition described above, the openings 48 are formed for the first manifold plate 24 arranged on the upper side, and the openings 49 are formed for the second manifold plate 25 arranged on the lower side. The position, at which the opening 48 is formed, is different from the position at which the opening 49 is formed, in the depth direction of the common ink chamber 31 (i.e., in the stacking direction). In other words, the openings 48, 49 of the first connecting channels 38*a*, 38*b* are disposed in a staggered arrangement in relation to the X direction which is the extending direction of the common ink chamber 31 and in the vertical direction which is the depth direction of the common ink chamber 31.

In FIG. 6, L represents the center-to-center distance between the adjoining openings 48, 49. FIG. 6 shows, by two-dot chain lines, a virtual opening 48' as arranged at the same position as that of the opening 49 in relation to the depth direction, wherein L' represents the distance between the center of the virtual opening 48' and the center of the opening 49. The distance L of this embodiment is longer than the distance L'. When the openings 48, 49 are disposed in the staggered arrangement, and the distance between the adjoining openings 48, 49 is lengthened as long as possible as described above, then the possibility is reduced for the backward movement component of the pressure wave transmitted to the common ink chamber 31 to be transmitted to any other pressure chamber 33 via the adjoining opening. Therefore, the effect is improved to suppress the so-called crosstalk phenomenon.

The openings of the first connecting channels 38*a* corresponding to the pressure chambers 10*a* disposed on the odd-numbered rows are arranged on the upper side, and the openings of the first connecting channels 38*b* corresponding to the pressure chambers 10*b* disposed on the even-numbered rows are arranged on the lower side. However, this arrangement may be inverted. The arrangement, in which the openings of the connecting channels are disposed in the staggered arrangement, may be also applied to the second connecting channels 39*a*, 39*b* in the same manner as described above.

Second Embodiment

Figure 7:
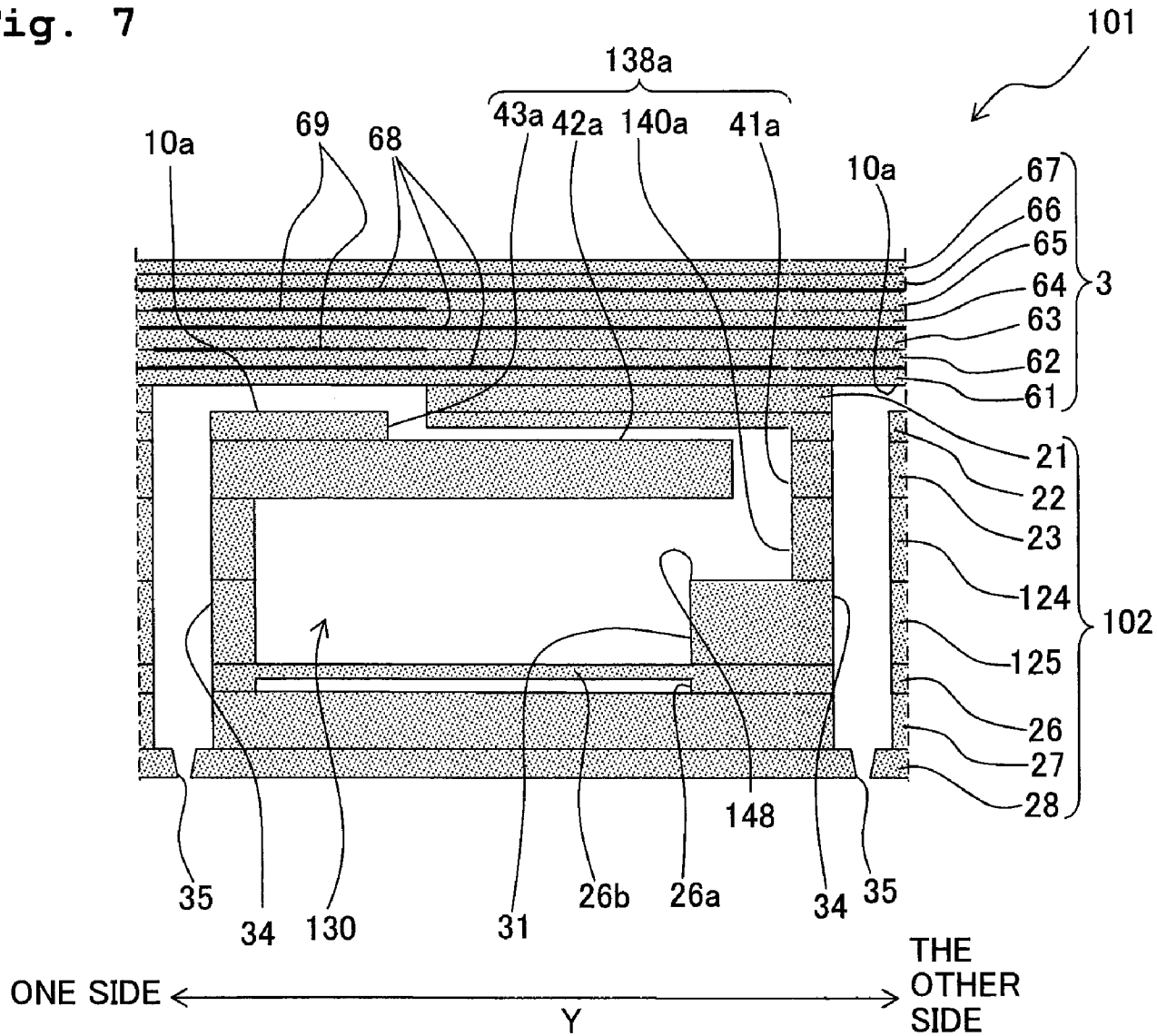
FIG. 7 shows a partial sectional view illustrating an ink-jet head of a second embodiment according to the present invention.
Figure 8:
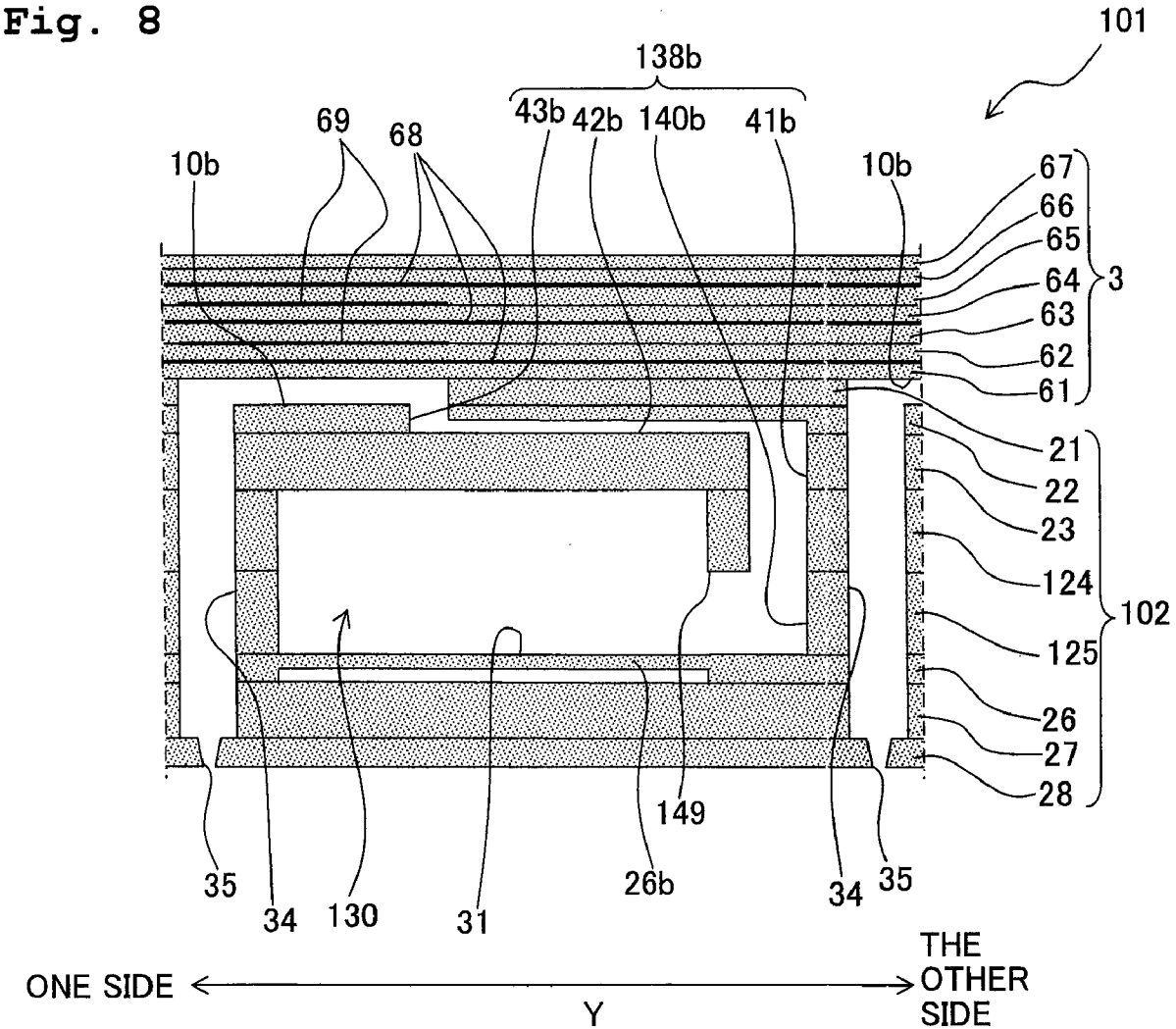
FIG. 8 shows a partial sectional view illustrating the ink-jet head of the second embodiment according to the present invention.

FIG. 7 shows a vertical cross-sectional shape of a first connecting channel 138*a* connected to the pressure chamber 10*a* arranged on an odd-numbered row of the first pressure chamber array disposed on one side in the Y direction. FIG. 8 shows a vertical cross-sectional shape of a first connecting channel 138*b* connected to the pressure chamber 10*b* arranged on an even-numbered row of the first pressure chamber array disposed on one side in the Y direction. In this embodiment, first upstream channels 140*a*, 140*b* of the respective first connecting channels 138*a*, 138*b* are different from those of the first embodiment. The parts or components, which are constructed in the same manner as in the first embodiment, are designated by the same reference numerals, any detailed explanation of which will be hereinafter omitted.

As shown in FIG. 7, the first connecting channel 138*a*, which forms a part of an ink channel 130 of a channel unit 102, has a first upstream channel 140*a*. Further, the first connecting channel 138*a* has the second upstream channel 41*a*, the throttle channel 42*a*, and the downstream channel 43*a* which are the same as those of the first embodiment.

The common ink chamber 31 is formed for first and second manifold plates 124, 125 in the same manner as in the first embodiment. The first upstream channel 140*a*, which is communicated with the other side in the Y direction of the common ink chamber 31, is formed as the through-hole for the first manifold plate 124. When the second connecting channel plate 23 and the second manifold plate 125 are stacked on the first manifold plate 124, the upper and lower openings of the first upstream channel 140*a* are defined by the lower surface of the second connecting channel plate 23 and the upper surface of the second manifold plate 125. The upstream end of the first upstream channel 140*a* is connected to the upper end portion on the other side in the Y direction of the common ink chamber 31.

The second upstream channel 41*a*, which is the same as or equivalent to that of the first embodiment, is formed for the second connecting channel plate 23 at the position corresponding to the end portion on the other side in the Y direction of the first upstream channel 140*a*. When the second connecting channel plate 23 and the first manifold plate 124 are stacked, the upstream end of the second upstream channel 41*a* is communicated with the downstream end of the first upstream channel 140*a*.

The connecting channel 138*a* is also communicated with the upper end portion of the common ink chamber 31. Therefore, the air, which makes invasion into the common ink chamber 31, is easily discharged in this structure.

As shown in FIG. 8, the first connecting channel 138*b* has a first upstream channel 140*b*. Further, the first connecting channel 138*b* has the second upstream channel 41*b*, the throttle channel 42*b*, and the downstream channel 43*b* which are the same as those of the first embodiment.

The through-hole, which defines a part of the common ink chamber 31, is formed for the second manifold plate 125 in the same manner as in the first embodiment. Further, the first upstream channel 140*b*, which is communicated with the other side in the Y direction of the common ink chamber 31, is formed therefor as the through-hole. When the first manifold plate 124 and the damper plate 26 are stacked on the second manifold plate 125, the first upstream channel 140*b* is defined by the lower surface of the first manifold plate 124 and the upper surface of the damper plate 26. The upstream end of the first upstream channel 140*b* is communicated with the lower end portion on the other side in the Y direction of the common ink chamber 31.

The through-holes, which define the second upstream channel 41*b*, are formed for the first manifold plate 124 and the first connecting channel plate 23 in the same manner as in the first embodiment. The second upstream channel 41*b* is formed at the position corresponding to the end portion on the other side in the Y direction of the first upstream channel 140*b*. When the first and second manifold plates 124, 125 are stacked, the upstream end of the second upstream channel 41*b* is communicated with the downstream end of the first upstream channel 140*b*.

The through-hole, which defines the first upstream channel 140*a* in relation to the first manifold plate 124, can be formed simultaneously with the formation of the through-hole for defining the common ink chamber 31. The through-hole, which defines the first upstream channel 140*b* in relation to the second manifold plate 125, can be formed simultaneously with the formation of the through-hole for defining the common ink chamber 31. Therefore, the first and second manifold plates 124, 125 can be easily processed as compared with the case in which the groove-shaped channel is constructed as in the first embodiment.

The first upstream channels 140*a*, 140*b* of this embodiment also extend from the upstream ends thereof toward the other side in the Y direction. The extending direction is opposite to the side on which the pressure chambers 10*a*, 10*b* to be connected are arranged, with respect to the common ink chamber 31. The first connecting channels 138*a*, 138*b* have the same shapes as those of the first embodiment shown in FIG. 4. In other words, the upstream portions of the throttle channels 42*a*, 42*b* of the first connecting channels 138*a*, 138*b* are arranged outside the common ink chamber 31. Therefore, the throttle channels 42*a*, 42*b* can be lengthened as long as possible in the same manner as in the first embodiment.

The opening 148 of the first upstream channel 140*a* is arranged on the lower side as compared with the opening 149 of the second upstream channel 140*b*. As for the first connecting channels 138, the openings 148, 149, which are aligned in the X direction, are disposed in a staggered arrangement in relation to the depth direction of the common ink chamber 31. Therefore, it is possible to enhance the effect to suppress the so-called crosstalk phenomenon in the same manner as in the first embodiment.

The connecting channel constructed as described above is also applicable to the second connecting channel in the same manner as described above without being limited to only the first connecting channel.

Third Embodiment

Figure 9:
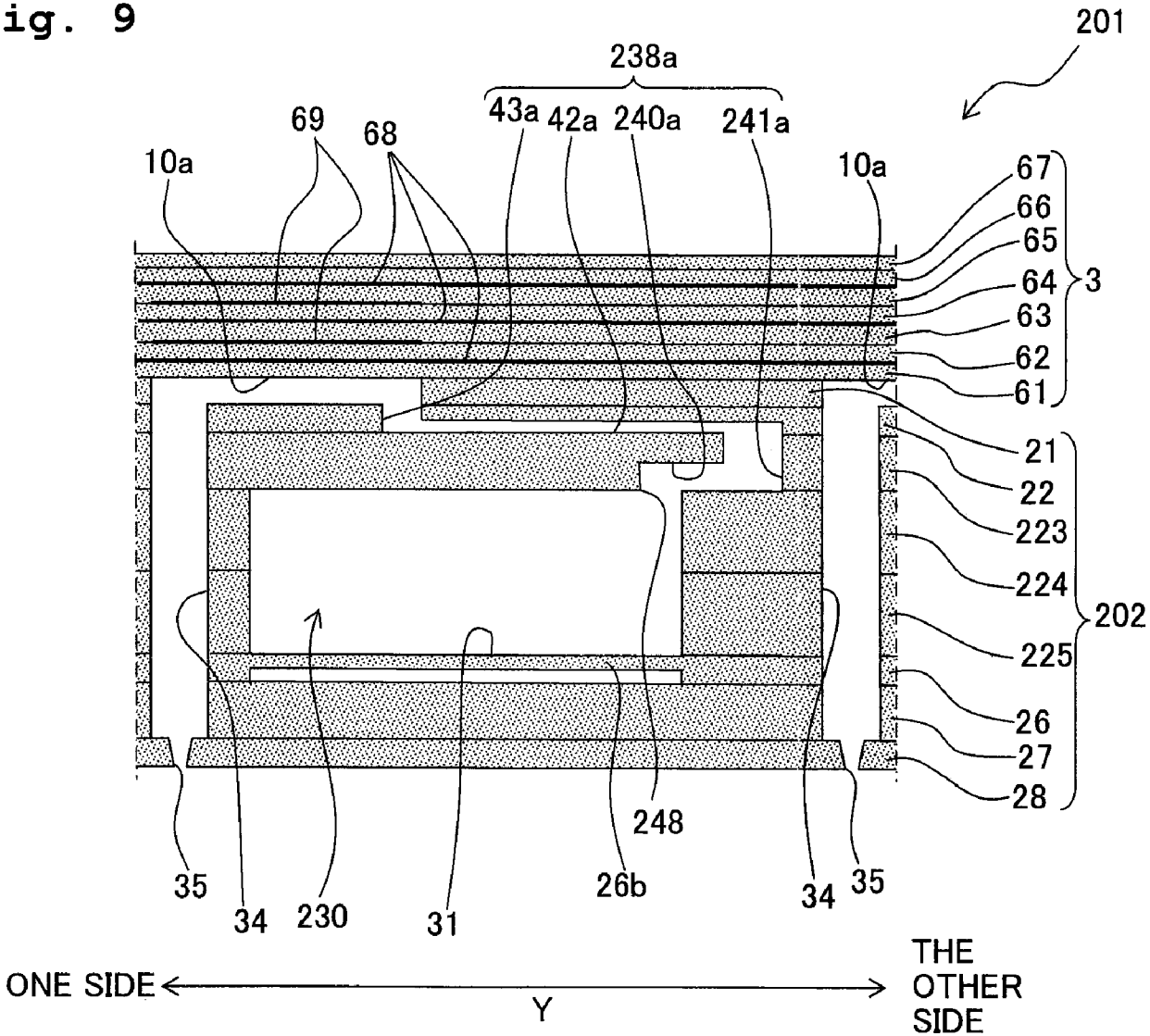
FIG. 9 shows a partial sectional view illustrating an ink-jet head of a third embodiment according to the present invention.

FIG. 9 shows a vertical cross-sectional shape of a first connecting channel 238*a* connected to the pressure chamber 10*a* for forming the first pressure chamber array 10 disposed on one side in the Y direction. In this embodiment, first and second connecting channels 240, 241 of the first connecting channel are different from those of the first embodiment. The parts or components, which are constructed in the same manner as in the first embodiment, are designated by the same reference numerals, any detailed explanation of which will be hereinafter omitted.

As shown in FIG. 9, the half etching processing is applied to the lower surface side of a second connecting channel plate 223. Accordingly, a first upstream channel 240*a* is formed as a groove which is open in the downward direction on the lower surface of the second connecting channel plate 223. The width (size or dimension in the X direction) of the first upstream channel 240*a* is equal to the width of the first upstream channel 40*a* shown in FIG. 4.

The end portion on one side in the Y direction of the first upstream channel 240*a* is formed to arrive at the position corresponding to the other end portion in the Y direction of the common ink chamber 31, more specifically to arrive at the area disposed inside the common ink chamber 31 as viewed in a plan view. The end portion on the other side in the Y direction of the first upstream channel 240*a* is formed to arrive at the outside of the common ink chamber 31 as viewed in a plan view.

A second upstream channel 241*a*, which penetrates in the vertical direction at the end portion on the other side in the Y direction of the first upstream channel 240*a* formed to have a groove shape, is formed for the second connecting channel plate 223. The second upstream channel 241*a* is formed after forming the first upstream channel 240*a*.

When the first manifold plate 224 and the second connecting channel plate 223 are stacked, the lower side of the first upstream channel 240 is defined by the lower surface of the first manifold plate 224. In this situation, the upstream end of the first upstream channel 240*a* is communicated with the upper end portion on the other side in the Y direction of the common ink chamber 31. The opening 248 of the first upstream channel 240*a* is formed on the upper surface of the common ink chamber 31. The second upstream channel 241*a* is constructed as the through-hole. The upstream end thereof is communicated with the downstream end of the first upstream channel 240*a*. When the second connecting channel plate 223 and the first connecting channel plate 22 are stacked, the upper opening of the second upstream channel 241*a* is communicated with the end portion on the other side in the Y direction of the throttle channel 42*a*. In other words, the downstream end of the second upstream channel 241*a* is communicated with the upstream end of the throttle channel 42*a*.

The shape of the first connecting channel 238*a* (238*b*) of this embodiment, which is viewed in a plan view, is the same as that shown in FIG. 4 except that the upstream end of the first upstream channel 240*a* (240*b*) is arranged inside the common ink chamber 31. In other words, the upstream portion of the throttle channel 42*a* (42*b*) is arranged outside the common ink chamber 31 as viewed in a plan view. The function and the effect, which are the same as or equivalent to those of the first embodiment, are obtained.

In this embodiment, neither through-hole nor groove for forming the connecting channel is formed for the first and second manifold plates 224, 225 for which the common ink chamber 31 is formed. Therefore, the first and second manifold plates 224, 225 can be processed with ease.

The arrangement of the connecting channel communicated with the pressure chamber 10*b* is also the same as or equivalent to the arrangement of the connecting channel communicated with the pressure chamber 10*a* described above, any explanation of which is omitted. Further, the connecting channel, which is constructed as described above, is also applicable to the second connecting channel in the same manner as described above without being limited to only the first connecting channel.

Fourth Embodiment

Figure 10:
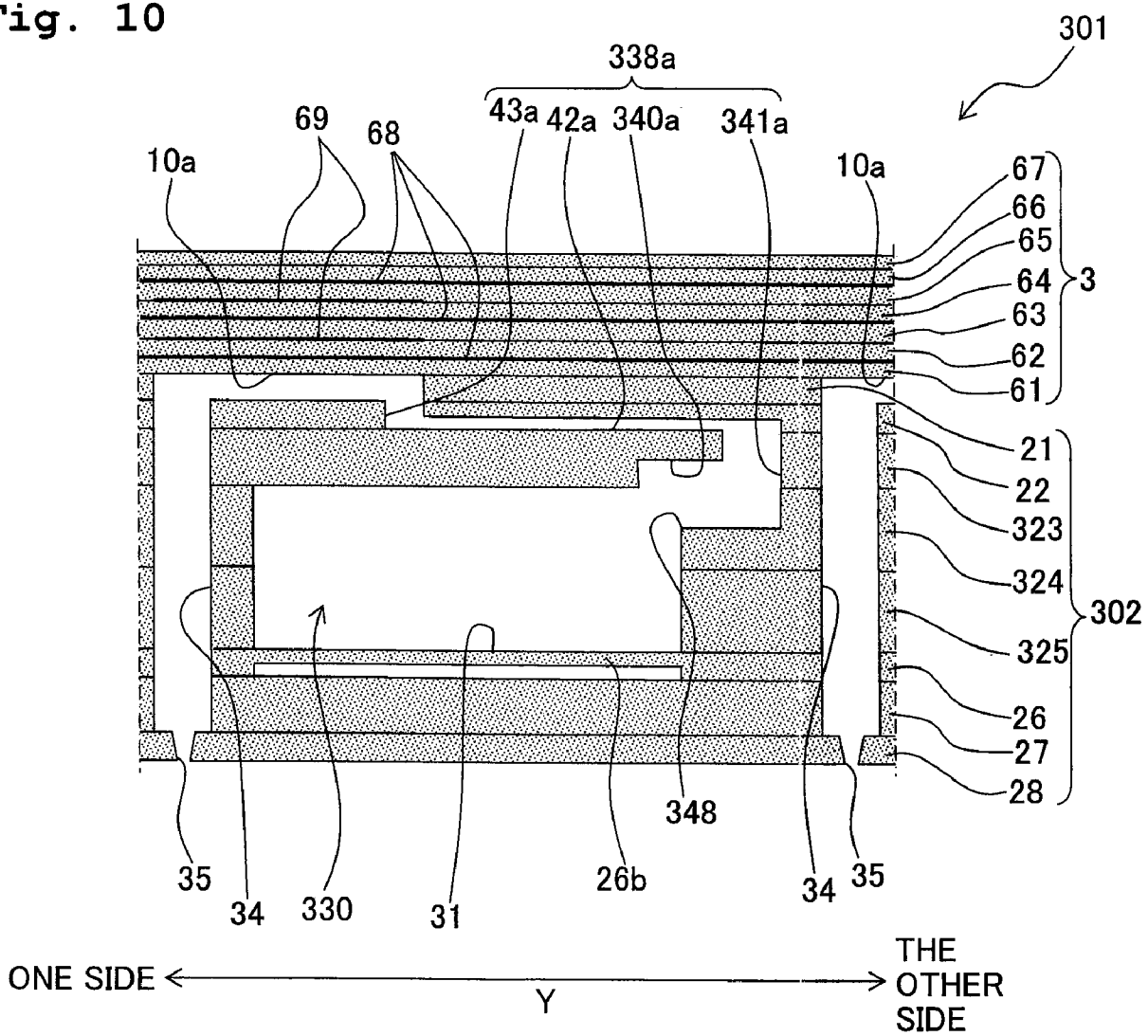
FIG. 10 shows a partial sectional view illustrating an ink-jet head of a fourth embodiment according to the present invention.

FIG. 10 shows a vertical cross-sectional shape of a first connecting channel 338*a* connected to the pressure chamber 10*a* for forming the first pressure chamber array 10 arranged on one side in the Y direction. In this embodiment, first and second upstream channels 340*a*, 341*a* of a first connecting channel 338*a* are different from those of the first embodiment. The parts or components, which are constructed in the same manner as in the first embodiment, are designated by the same reference numerals, any detailed explanation of which will be hereinafter omitted.

As shown in FIG. 10, a second connecting channel plate 323 is formed with a groove which defines a part of the first upstream channel 340*a* and which is formed in the same manner as the first upstream channel 240*a* of the third embodiment (see FIG. 9) and a through-hole which defines the second upstream channel 341*a* and which is formed in the same manner as the second upstream channel 241*a* of the third embodiment (see FIG. 9). A first manifold plate 324 is formed with a groove which is formed in the same manner as the first connecting channel 40*a* of the first embodiment (see FIG. 2), which is communicated with the common ink chamber 31, and which defines parts of the first and second upstream channels 340*a*, 341*a*.

When the first manifold plate 324 and the second connecting channel plate 323 are stacked, the upstream end of the first upstream channel 340*a* is communicated with the upper end portion on the other side in the Y direction of the common ink chamber 31. Therefore, the opening 348, which is disposed at the upstream end of the first upstream channel 340*a*, is formed to range over the upper surface of the common ink chamber 31 and the side surface on the other side in the Y direction, and the opening 348 provides an L-shaped cross section. The second upstream channel 341*a* is formed as the through-hole, and the upstream end thereof is communicated with the downstream end of the first upstream channel 340*a*. When the second connecting channel plate 323 and the first connecting channel plate 22 are stacked, the downstream end of the second upstream channel 341*a* is communicated with the upstream end of the throttle channel 42*a*.

The shape of the first connecting channel 338 of this embodiment, which is viewed in a plan view, is the same as that of the third embodiment. In other words, the upstream portion of the throttle channel 42 is arranged outside the contour line of the common ink chamber 31 as viewed in a plan view, wherein the function and the effect, which are the same as or equivalent to those of the first embodiment, are obtained.

In this exemplary arrangement, the opening of the first connecting channel 338*a* (338*b*) is formed to range over the upper surface and the side surface, which is increased as large as possible. Therefore, the channel resistance is decreased around the opening. The ink is easily supplied toward the pressure chamber, and the air, which stays or remains on the upper surface side of the common ink chamber 31, is easily discharged.

The arrangement of the connecting channel communicated with the pressure chamber 10*b* is also the same as or equivalent to the arrangement of the connecting channel communicated with the pressure chamber 10*a* described above, any explanation of which is omitted. Further, the connecting channel, which is constructed as described above, is also applicable to the second connecting channel in the same manner as described above without being limited to only the first connecting channel.

Fifth Embodiment

Figure 11:
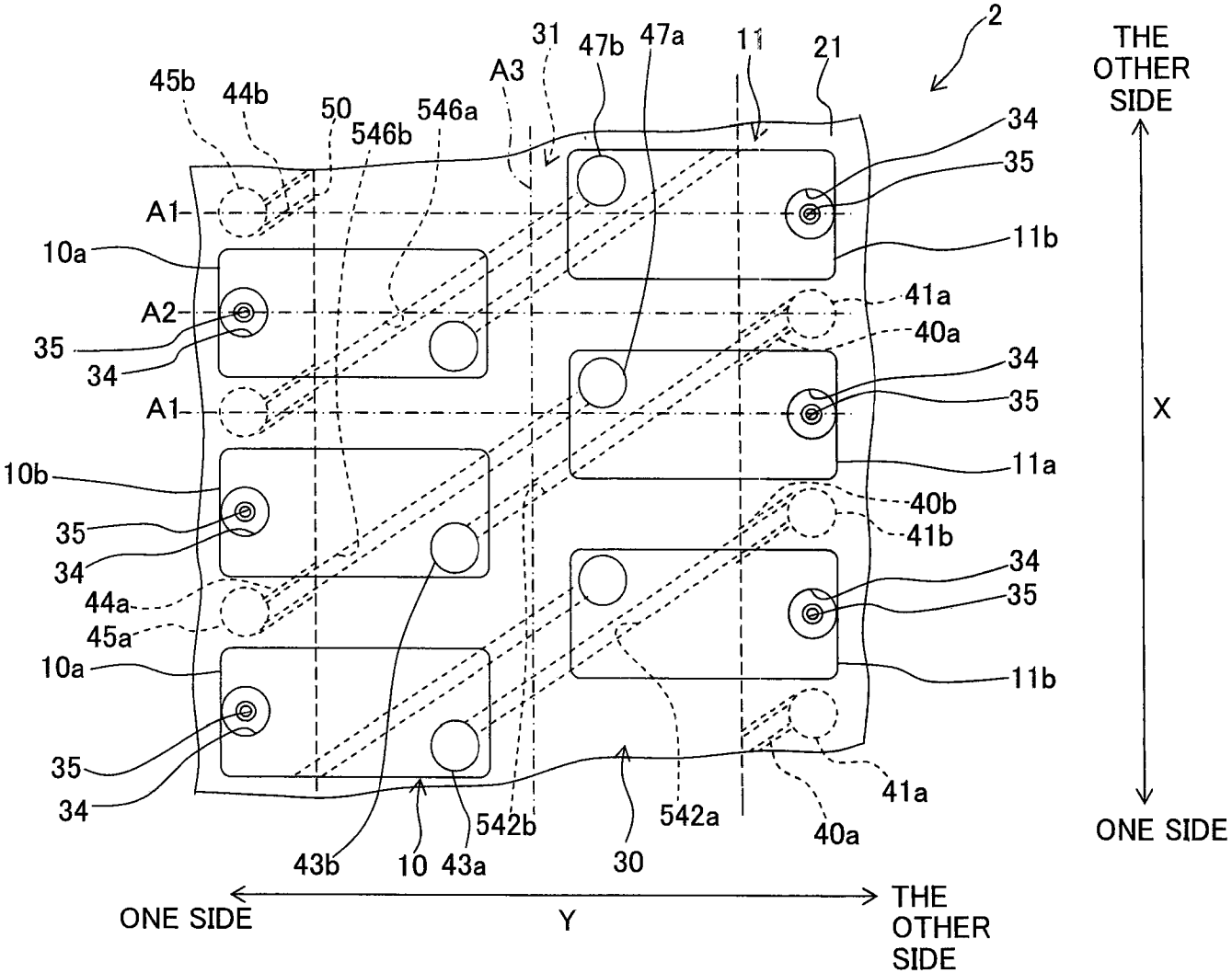
FIG. 11 shows a view corresponding to FIG. 4, illustrating an ink-jet head of a fifth embodiment according to the present invention.

In the respective embodiments described above, the throttle channels 42*a*, 42*b*, 46*a*, 46*b* extend in the direction (Y direction) perpendicular to the extending direction of the common ink chamber 31. However, the present invention is not limited thereto. The throttle channels may be arranged in any direction intersecting the extending direction of the common ink chamber 31. For example, as shown in FIG. 11, throttle channels 542*a*, 542*b*, 546*a*, 546*b* may extend obliquely with respect to the Y direction. In this arrangement, it is also allowable that downstream channels 43*a*, 43*b*, 47*a*, 47*b*, which communicate the throttle channels 542*a*, 542*b*, 546*a*, 546*b* and the pressure chambers 10*a*, 10*b*, 11*a*, 11*b*, are not arranged on the center lines of the pressure chambers 10*a*, 10*b*, 11*a*, 11*b*. As shown in FIG. 11, the downstream channels 43*a*, 43*b*, 47*a*, 47*b* may be arranged while being deviated from the center lines of the pressure chambers 10*a*, 10*b*, 11*a*, 11*b*.

The embodiments according to the present invention have been explained above. However, the embodiments can be appropriately changed or modified without deviating from the scope of the present invention, without being limited to the arrangements described above. Two or more of the channel structures individually explained as the respective embodiments may be applied to a single ink-jet head.

In the embodiments of the present invention, the present invention is applied to the ink-jet head to be carried on the ink-jet printer. However, the present invention is also preferably applicable, for example, to heads of liquid droplet discharge apparatuses to be used, for example, for the apparatus for producing a color filter for a liquid crystal discharge apparatus by discharging a coloring liquid, and the apparatus for forming an electric wiring by discharging a conductive liquid.

As described above, the liquid discharge head according to the present invention has such an excellent effect that the liquid discharge head contributes to the small sizing and the highly densified arrangement. The liquid discharge head according to the present invention is advantageous when the liquid discharge head is applied, for example, to the ink-jet head to be carried on the inkjet printer.

What is claimed is:

1. A liquid discharge head which discharges a liquid, comprising:

a channel unit including:

a first pressure-chamber array in which a plurality of first pressure chambers are aligned in one direction;

a second pressure-chamber array which is arranged next to the first pressure-chamber array in an intersection direction intersecting the one direction, and in which a plurality of second pressure chambers are aligned in the one direction;

a plurality of nozzles which are formed corresponding to the first and second pressure chambers, respectively, and through which the liquid is discharged;

a common liquid chamber storing the liquid which is commonly distributed to the first and second pressure chambers and extending in the one direction; and a plurality of connecting channels through which the liquid is supplied from the common liquid chamber to the first and second pressure chambers, the connecting channels having a plurality of first connecting channels corresponding to the first pressure chambers and a plurality of second connecting channels corresponding to the second pressure chambers; and an actuator unit which selectively applies a discharge pressure to the liquid in the first and second pressure chambers;

wherein the first and second pressure chamber arrays are arranged on one side and the other side of the common liquid chamber in the intersection direction, respectively, such that the first and second pressure chambers are arranged in a staggered manner in the one direction;

wherein each of the first connecting channels extends in the intersection direction from one of the first pressure chambers in a portion of the channel unit between the second pressure chambers, up to an area, of the channel unit, not overlapped with the common liquid chamber on the other side of the common liquid chamber to make communication with the common liquid chamber;

wherein each of second connecting channels extends in the intersection direction from one of the second pressure chambers in a portion of the channel unit between the first pressure chambers, up to an area, of the channel unit, not overlapped with the common liquid chamber on the one side of the common liquid chamber to make communication with the common liquid chamber; and wherein the first connecting channels and the second connecting channels are arranged alternately in relation to the one direction.

2. The liquid discharge head according to claim 1;

wherein the intersection direction is perpendicular to the one direction.

3. The liquid discharge head according to claim 2;

wherein one of the first connecting channels and the second connecting channels are communicated with an upper end portion, of the common liquid chamber, in a vertical direction.

4. The liquid discharge head according claim 2;

wherein the plurality of first connecting channels have inflow ports which are open on the other side of the common liquid chamber respectively; and wherein the inflow ports of the first connecting channels are arranged such that adjacent inflow ports among the plurality of the inflow ports have height positions which are different from each other.

5. The liquid discharge head according to claim 2;

wherein the plurality of second connecting channels have inflow ports which are open on the one side of the common liquid chamber respectively; and wherein the inflow ports of the second connecting channels are arranged such that adjacent inflow ports among the plurality of the inflow ports have height positions which are different from each other.

6. The liquid discharge head according to claim 2;

wherein the channel unit has a plurality of stacked plate members, the plate members including:

a manifold plate having a manifold hole which is formed in the manifold plate to define the common liquid chamber;

a pressure chamber plate having a plurality of pressure chamber holes which are formed in the pressure chamber plate to define the pressure chambers; and a connecting channel plate arranged between the manifold plate and the pressure chamber plate and having connecting holes or grooves which are formed in the connecting channel plate to define the connecting channels;

wherein an upstream end portion of each of the connecting channels is defined by an etching-groove formed by half etching on a surface of the manifold plate, the surface being disposed on a side on which the connecting channel plate is to be arranged; and wherein one end of the etching-groove is connected to the manifold hole, and the other end of the etching-groove is communicated with one of the connecting grooves or holes of the connecting channel plate.

7. A printer comprising:

the liquid discharge head as defined in claim 1;

a transport mechanism which transports a predetermined printing paper sheet to a position opposed to the liquid discharge head; and a liquid cartridge which stores a liquid to be supplied to the liquid discharge head and which is in liquid communication with the liquid discharge head.

* * * * *